United States Patent [19]

Uehara

[11] 4,014,073

[45] Mar. 29, 1977

[54] ADJUSTABLE ROLLER CONSTRUCTION FOR WINDOWS, DOORS OR THE LIKE

[75] Inventor: Takeo Uehara, Uozu, Japan

[73] Assignee: Yoshida Kogyo Kabushiki Kaisha, Japan

[22] Filed: Nov. 11, 1974

[21] Appl. No.: 522,533

[30] Foreign Application Priority Data

Nov. 27, 1973 Japan ..... 48-137566[U]

[52] U.S. Cl. ..... 16/105

[51] Int. Cl.[2] ..... E05D 15/06

[58] Field of Search ..... 49/425; 16/105

[56] References Cited

UNITED STATES PATENTS

| | | | |
|---|---|---|---|
| 345,314 | 7/1886 | McMillan | 16/105 |
| 2,746,080 | 5/1956 | Pearson | 16/105 |
| 3,670,357 | 6/1972 | Steigerwald | 49/425 X |

*Primary Examiner*—Kenneth Downey
*Attorney, Agent, or Firm*—Bucknam and Archer

[57] ABSTRACT

A roller is rotatably supported by a roller holder which in turn is supported by a mounting frame so as to be adjustably displaceable downwardly relative to the latter when pressed by an adjusting screw. The adjusting screw includes a flange fixedly mounted thereon just below its slotted head, and the mounting frame has stop means engageable with the flange on the adjusting screw to restrain the latter from movement in its loosening direction.

3 Claims, 4 Drawing Figures

ADJUSTABLE ROLLER CONSTRUCTION FOR WINDOWS, DOORS OR THE LIKE

BACKGROUND OF THE INVENTION

This invention relates to a roller construction for horizontally moving windows, doors or the like. More specifically, the invention relates to a roller construction in which the position of the roller is adjustable vertically relative to a mounting frame by means of an adjusting screw.

An adjustable roller construction is known in which a roller holder rotatably carrying a roller is displaceably supported by a mounting frame and in which an adjusting screw is turned to press the roller holder and hence to cause the roller to descend to a desired degree relative to the mounting frame. With this type of adjustable roller construction, it is necessary to prevent the detachment of the adjusting screw by some means or other as the screw is easy to loosen.

Heretofore, in order to accomplish this objective, the tip of the adjusting screw has been flattened, or the end face of the adjusting screw has been pressed into an expanding flange, after the screw has been mounted in position. According to these well known measures, the adjusting screw tends to bend, and the pitch of its threads to become impaired, while pressure is being exerted thereon for the flattening or expanding of its tip. The smooth and precise adjustment of the roller position cannot of course be effected by use of such deformed adjusting screw. Furthermore, the flattening or expanding of the adjusting screw tip must be carried out within a narrow spacing delimited by the mounting frame and the roller holder, at the expense of substantial time and labor.

SUMMARY OF THE INVENTION

It is, therefore, an object of this invention to provide a roller construction for horizontally moving windows, doors or the like, including an adjusting screw of improved configuration which is well adapted to permit easy and precise adjustment of the vertical position of the roller with respect to the window, door or the like and which can be undetachably retained in position without being deformed as has been practiced heretofore.

Still another object of the invention is to provide an adjustable roller construction wherein the adjusting screw can be easily produced in a minimum of time and expense.

Briefly, the invention is directed to the type of roller construction wherein the roller is rotatably supported by a roller holder which in turn is supported by a mounting frame so as to be adjustably depressed relative to the latter when applied with a pressure in a predetermined direction. In order to impart the desired pressure to the roller holder, an adjusting screw is used which according to the invention includes a flange fixedly mounted on its threaded shank just below the head. The mounting frame includes stop means engageable with the flange on the adjusting screw to limit the movement of the adjusting screw in its loosening direction, so that there is practically no possibility of the detachment of the adjusting screw in the use of the roller construction.

The features which are believed to be novel and characteristic of this invention are set forth with particularity in the appended claims. The invention itself, however, both as to its organization and mode of operation, together with the further objects and advantages thereof, will be best understood from the following description taken in connection with the accompanying drawings which illustrate, by way of example only, some preferred embodiments of the invention and wherein like reference characters denote corresponding parts of the several views.

DESCRIPTION OF THE PREFERRED EMBODIMENTS

Figure 1:
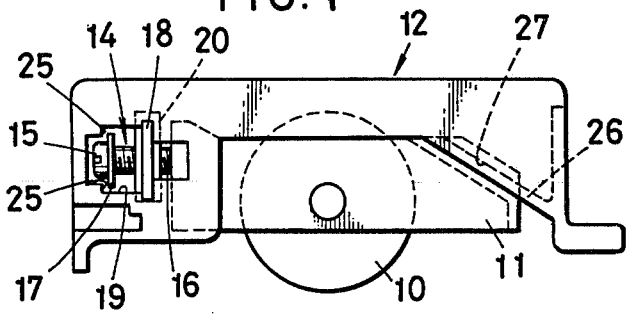
FIG. 1 is a side elevational view of a roller construction which represents one of the specific adaptations of this invention.

The first preferred embodiment of the invention will now be described in detail with reference to FIGS. 1 and 2. A roller 10 is rotatably supported by a roller holder 11 which in turn is supported by a mounting frame 12 so as to be vertically adjustable within predetermined limits relative to the latter, as hereinafter described in more detail. The mounting frame 12 includes a pair of vertical side walls 13 arranged in parallel spaced relationship to each other.

The reference numeral 14 generally designates an adjusting screw according to the invention. The adjusting screw 14 comprises a slotted head 15, a threaded shank 16, and a flange 17 projecting laterally from the threaded shank just below the slotted head. The flange 17 may be circular in shape and is significantly greater in diameter than the slotted screw head 15. In one form of construction, the blank shank of the adjusting screw 14 may first be inserted fully into and through a central opening in a disc member which is to become the flange 17, and then the screw threads may be formed on the blank shank by rolling operation. In this manner the crests of the screw threads, being greater in diameter than the original blank shank, can be utilized to restrain the flange in position upon the shank. The adjusting screw of the foregoing construction is further inserted into a tapped hole of a supporting plate 18 which is shown to be rectangular in shape.

The adjusting screw 14 together with the supporting plate 18 is installed in position between the opposed side walls 13 of the mounting frame 12 adjacent one end thereof. These side walls of the mounting frame have identical apertures 19 therethrough in exactly registered relationship. The adjusting screw 14 together with the supporting plate 18 is inserted into position between the opposed side walls 13 through one of the apertures 19 formed therethrough. With the adjusting screw thus installed within the mounting frame 12, both side portions of each of the flange 17 and the supporting plate 18 project into the respective apertures 19 in the side walls 13. A retainer 20 best illustrated in FIG. 2 is then inserted into the mounting frame 12 through its open top. This retainer is so shaped as to hold therein the supporting plate 18 and part of the threaded shank 16 of the adjusting screw 14 and is adapted to rigidly connect the supporting plate to the mounting frame 12. The adjusting screw including the flange 17 is thus operatively mounted in position within the mounting frame 12.

Each of the apertures 19 in the mounting frame side walls 13 is symmetrical with respect to its horizontal axis, including a portion 21 having a vertical dimension sufficient to permit the flange 17 on the adjusting screw 14 to pass therethrough and a horizontal dimension less than the threaded shank 16 of the adjusting screw. Formed on the right hand side, as viewed in FIGS. 1 and 2, is a portion 22 having a greater vertical dimension than the portion 21 to permit the supporting plate 18 to pass therethrough. The portion 22 is further open to a portion 23 through which the end portion of the threaded shank 16, remote from the slotted head 15, will pass when the adjusting screw is being inserted into position within the mounting frame 12. The first mentioned portion 21 of the aperture 19 is open on its left hand side to a portion 24 having a suitably less vertical dimension than the portion 21 to permit the slotted head 15 of the adjusting screw 14 to pass therethrough.

As will be seen from FIG. 1 in particular, shoulders or steps 25 defined between the portions 21 and 24 of each aperture 19 are designed to serve as stop means engageable with the flange 17 on the adjusting screw 14. The stop means 25 will function to limit the movement of the adjusting screw in its loosening or retracting direction.

Figure 2:
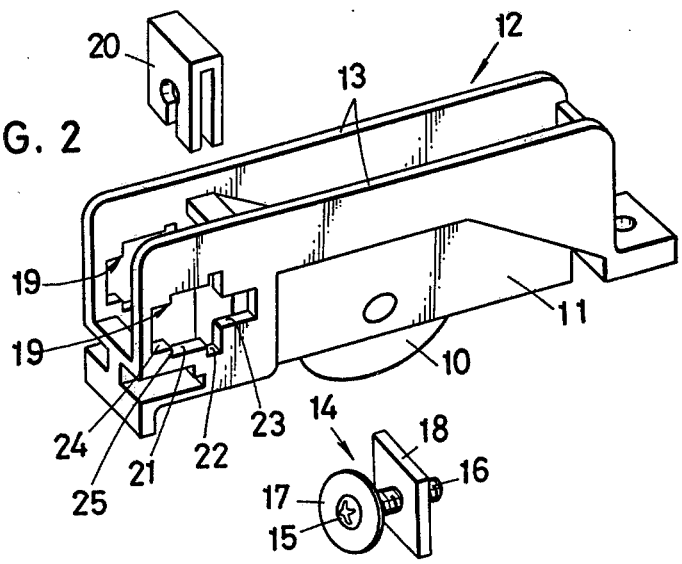
FIG. 2 is an exploded perspective view of the roller construction shown in FIG. 1.

In the construction illustrated in FIGS. 1 and 2, the tip of the threaded shank 16 of the adjusting screw 14 away from the head 15 is held in abutting relationship to the roller holder 11 within the mounting frame 12. The rotation of the adjusting screw in its advancing direction is to be translated into the downward motion of the roller holder 11, and therefore of the roller 10, relative to the mounting frame 12. The position of the roller 10 is thus adjustable vertically with respect to the mounting frame 12. Such movement of the roller 10 and the roller holder 11 can be accomplished, for example, by the provision of slanting guides 26 and grooves 27 at or adjacent the ends of the mounting frame 12 and the roller holder 11, respectively, away from the adjusting screw 14. The guides 26, of course, are slidably received in the grooves 27, so that the roller holder 11 together with the roller 10 is caused to slide downwardly of the mounting frame 12 upon rotation of the adjusting screw 14 in is advancing direction.

Figure 3:
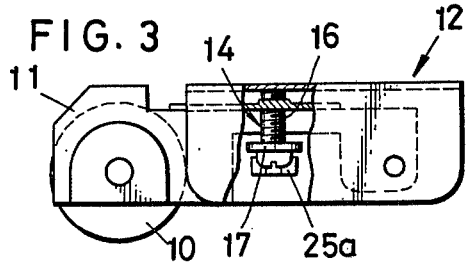
FIG. 3 is a partly broken away side elevational view of another specific adaptation of the invention.
Figure 4:
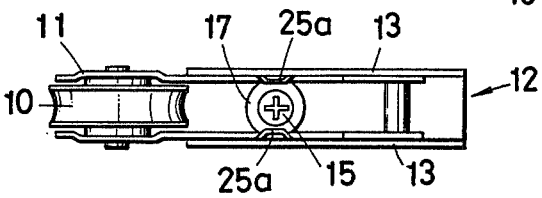
FIG. 4 is a bottom plan view of the roller construction shown in FIG. 3.

The concepts of this invention are applicable not only to the roller construction of the type shown in FIGS. 1 and 2, in which the adjusting screw 14 is arranged horizontally or at right angles to the direction in which the position of the roller 10 is to be adjusted. In FIGS. 3 and 4, the inventive concepts are applied to a more general type of roller construction in which the adjusting screw 14 is arranged vertically. It will be observed from the drawings that a pair of inwardly projecting stops **25*a* are formed on the respective side walls 13 of the mounting frame 12 to check the movement of the adjusting screw 14 in its loosening direction by engaging the flange 17 thereon. These stops 25*a* may be formed by parts of the mounting frame side walls 13**, as by subjecting the latter to a punch press.

Although some illustrative embodiments of this invention have been described in detail herein with reference to the accompanying drawings, it is to be understood that the invention is not limited to those precise embodiments and that various changes and modifications may be resorted to by one skilled in the art without departing from the spirit or scope of the invention.

What is claimed is:

1. In a roller device of the type including a roller, a roller holder rotatably supporting said roller, and a mounting frame supporting said roller holder in such a manner that said roller holder is adjustably displaceable outwardly relative to said mounting frame when applied with a pressure in a predetermined direction, the combination comprising an inclined surface on said roller holder disposed for sliding engagement with an inclined surface on said mounting frame to guide said roller holder for movement outwardly relative to the mounting frame upon application to said roller holder of a pressure in said predetermined direction, an adjusting screw adapted to apply pressure to said roller holder in said predetermined direction to cause the outward displacement of said roller holder relative to said mounting frame, said adjusting screw having a flange fixedly mounted thereon just below its head, and stop means on said mounting frame positioned to limit the movement of said adjusting screw in its loosening direction by engaging said flange thereon, said roller being supported by said roller holder for rotation relative thereto about an axis fixed with respect to the roller holder and adjustable relative to said mounting frame in accordance with the position of said adjusting screw.

2. The combination as set forth in claim 1, wherein said mounting frame includes a pair of opposed side walls adapted to accommodate said adjusting screw therebetween, and wherein a pair of substantially identical apertures are formed through the respective side walls of said mounting frame to permit said adjusting screw to pass therethrough into position between said side walls, said apertures having stepped portions adapted to function as said stop means.

3. The combination as set forth in claim 1, wherein said mounting frame includes a pair of opposed side walls adapted to accommodate said adjusting screw therebetween, and wherein a pair of inward projections are formed on the respective side walls of said mounting frame, said inward projections being adapted to function as said stop means.

* * * * *